United States Patent [19]

Soper

[11] Patent Number: 4,644,843

[45] Date of Patent: Feb. 24, 1987

[54] GAS ACTUATED GUN SYSTEM FOR LAUNCHING A PROJECTILE

[75] Inventor: William G. Soper, King George, Va.

[73] Assignee: The United States of Amercia as represented by the Secretary of the Navy, Arlington, Va.

[21] Appl. No.: 774,516

[22] Filed: Sep. 10, 1985

[51] Int. Cl.[4] ..... F41F 1/04

[52] U.S. Cl. ..... 89/7

[58] Field of Search ..... 89/7, 8, 135, 28.05; 42/84; 60/532

[56] References Cited

U.S. PATENT DOCUMENTS

| | | | |
|---|---|---|---|
| 2,129,875 | 9/1938 | Rost | 89/7 |
| 2,981,153 | 4/1961 | Wilson et al. | 89/7 |
| 3,046,737 | 7/1962 | Ottestad | 89/7 |
| 3,102,553 | 9/1963 | Ottestad | 60/532 |
| 3,496,827 | 2/1970 | Dardick | 89/8 |
| 3,712,171 | 1/1973 | Sweigart | 89/7 |
| 4,038,903 | 8/1977 | Wohlford | 89/8 |
| 4,047,465 | 9/1977 | Wohlford | 89/8 |
| 4,057,002 | 11/1977 | Donovan | 89/8 |

*Primary Examiner*—Stephen C. Bentley
*Assistant Examiner*—Stephen Johnson
*Attorney, Agent, or Firm*—Elmer E. Goshorn; Thomas E. McDonnell

[57] ABSTRACT

An improved and repetitively operable gaseous-propellant gun system for launching one or more projectiles to strike a target, especially a relatively high-speed target at close range. The system is generally made up of a housing having a chamber therein with enlarged and reduced chamber portions. A double-acting piston includes enlarged and reduced tandem pistons for advancement in opposite directions within the chamber. A gaseous source means controls the admittance or release of a lightweight gaseous medium to the reduced chamber portion. A projectile support and handling arrangement functions to securely position a projectile in the barrel bore. A forced air inlet and exhaust subassembly not only admits a first volume of air to be compressed between the enlarged piston and the housing but also admits a second volume of air between the enlarged and reduced pistons so as to biasingly urge the double-acting piston towards the enlarged chamber end of the housing. A fuel injection subassembly timely introduces during each operative cycle of the system a predetermined amount of fuel, such as, e.g., a suitable grade of diesel fuel or ordinary gas turbine fuel for marine vessels, into the compressed air so as to form an ignitable and explosive fuel-air admixture for driving the double-acting piston in a direction to further pressurize the gaseous means in order to cause fracture of the projectile from its support and launching of the projectile from the barrel at a relatively high velocity to strike a target.

25 Claims, 6 Drawing Figures

GAS ACTUATED GUN SYSTEM FOR LAUNCHING A PROJECTILE

This invention relates to a gaseous-propellant gun system for launching a projectile and, more particularly, it relates to an improved gaseous-propellant gun system for launching one or more projectiles to strike a target.

BACKGROUND OF THE INVENTION

Various gaseous-propellant gun systems for launching a projectile have been developed in the past. For example, U.S. Pat. No. 2,129,875 to Rost discloses a firearm for propelling a projectile. The firearm is generally comprised of a single-acting piston, a compression chamber, a barrel with a bore for receiving and launching a projectile and a gasoline injection apparatus. Upon advancement of the piston toward the barrel bore and ignition of the compressed fuel-air admixture, the projectile is launched. To assist and enhance the propulsion of the projectile from the firearm, the projectile is provided with a solid composition of potassium chlorate that serves as an oxidant in enabling faster burning of and greater thrust generation by the admixture. U.S. Pat. No. 3,496,827 to Dardick concerns a repetitively operable double-breech gun system. The system is generally made up of a primary breech for receiving a conventionally fired piston and a secondary breech for receiving and releasably holding the projectile to be launched. A compressible gaseous propellant chamber is interposed between the breeches. Upon firing of the piston, the gaseous medium in the chamber, such as helium or hydrogen is compressed, thereby launching the projectile. U.S. Pat. No. 3,712,171 to Sweigart concerns a liquid-propellant gun system. The system is provided with a liquid propellant receiving chamber and a combustion chamber. A normally-closed gate valve and a spring-biased piston separate the chambers. Upon admission of the propellant into the propellant chamber, the piston is advanced in one direction against the action of its spring bias towards the combustion chamber. Opening the valve forces the propellant into the combustion chamber for causing launching of the projectile as the result of the spring urging the piston in the opposite direction. U.S. Pat. No. 4,047,465 to Wohlford concerns a gun system for launching a projectile. The system is generally made up of a solid-propellant filled chamber, a lightweight gaseous medium filled chamber and a liner for separating the chambers. Upon ignition of the propellant, the liner advances in more than one direction to progressively collapse the gaseous medium chamber thereby compressing the gaseous medium therein so as to cause launching of the projectile. U.S. Pat. No. 4,038,903 to Wohlford relates to a gun system of telescopic construction for launching a projectile. The system is generally made up of a piston-barrel subassembly and a closed end cylinder for slidably receiving the barrel piston subassembly between its ends. A solid propellant is disposed at one end of the cylinder and a lightweight gaseous medium at the other end. A fracturable pin is connected to a projectile so as to prevent accidental launch of the projectile from the barrel of the subassembly until the gaseous medium is sufficiently compressed after ignition of the propellant during system use. However, none of the aforediscussed references, whether taken alone or in any combination, remotely suggest an improved gaseous-propellant gun system for launching one or more projectiles. The system has, among other things, a housing that is provided with an internal combustion chamber at one end, and a lightweight gaseous medium chamber at the opposite end. A projectile receiving barrel is connected to the housing. A double-acting piston is slidably mounted in the chambers for reciprocal advancement between the ends of the housing. A projectile support and handling arrangement functions to position the projectile in the barrel bore. Upon advancement of the piston means, the gaseous medium is compressed and causes launching of the projectile when the projectile is separated from the projectile support and handling arrangement.

SUMMARY OF THE INVENTION

An object of the invention is to provide an improved gaseous-propellant gun system for using conventional internally combustible fuels to rapidly compress a lightweight gaseous propellant so as to cause launching of a projectile therefrom.

Another object of the invention is to provide an improved gaseous-propellant gun system that enables repetitive and rapid cycling of the system for rapidly launching a plurality of successive projectiles so as to increase the probability of striking a fast moving target.

Still another object of the invention is to provide an improved gaseous-propellant gun system that can be readily mounted onto existing gun platforms of a naval vessel and the like and readily integrated into the fire control system thereof.

Still yet another object of the invention is to provide an improved gaseous-propellant gun system that enables either manual or automatic operation for causing launching or projectiles in either intermittent or rapid successive fashion as required to strike a target.

In summary, the invention relates to an improved gaseous-propellant gun system for either intermittently or rapidly launching one or more projectiles. The system is generally made up of a housing means having an enlarged internal combustion chamber at one end and a reduced gaseous-propellant receiving chamber at the opposite end. A double-acting piston means is provided with enlarged and reduced pistons for reciprocating advancement between the chambers of the tandem housing means during system use. A barrel is connected to the opposite end of the housing means. A projectile support and handling arrangement is associated with the housing means for securely positioning a projectile in the barrel bore. One of the advantages of the projectile support and handling arrangement is that it positively restrains the projectile from launch until the gaseous medium is sufficiently compressed; and this medium acts, when so compressed, upon a pressure responsive surface portion of the projectile for causing fracture of the projectile from its support and handling arrangement thereby launching same from the barrel during system use. After launch of the projectile, the arrangement without the projectile can be readily removed from the housing means prior to feeding another arrangement with a projectile into the housing means.

A forced air inlet and exhaust arrangement is connected to the housing means for admitting not only a volume of air to be compressed in the enlarged chamber between the housing means and the enlarged piston but also a flow of air to biasingly urge the enlarged piston toward the one end of the housing means so as to assist in compressing the volume of gas in the enlarged (combustion) chamber. A lightweight gaseous source means is connected to the housing means for furnishing a continuous supply of a lightweight gaseous medium to the reduced chamber portion so as to biasingly urge the double-acting piston means towards the one end of the housing means. On the other hand, the gaseous medium is compressed so as to cause launching of the projectile when the double acting piston means is forcibly driven toward the opposite end of the housing means. A fuel injection arrangement is connected to the housing means for timely injecting a predetermined amount of fuel, such as, e.g., a suitable grade of fuel oil or a suitable grade of gas turbine fuel for marine vessels, for mixing with the compressed volume of air to form an ignitable fuel-air admixture. Upon ignition and explosion of the admixture, the piston means is forcibly driven toward the opposite end of the housing means for progressively compressing the gaseous, projectile-propellant medium and ultimately launching the projectile from the system barrel. In order to assure that the piston means completes its advancement towards the opposite end of the housing means while at the same time minimizing the impact of the enlarged piston portion with a shoulder between the chamber portions of the housing means, a vent is provided in the housing means for continuously venting a preselected amount of air from the enlarged chamber portion thereof between the tandem pistons.

A bleed valve is interposed between the housing means and the lightweight gaseous source means. One advantage of the bleed valve is that it releases the lightweight gaseous source means from the housing means in order to stop operation of the system when the lightweight gaseous source means is turned off.

In another advantageous embodiment of the invention, a master computerized control may be provided for selectively and automatically controlling the coordinated operations of the fuel injection arrangement, the projectile support and handling mechanism, etc., thereby selectively and automatically controlling the rapid successive or intermittent launching of one or more projectiles for destroying a target.

Other objects and advantages of the invention will become apparent from the following detailed description of the invention when considered in conjunction with the accompanying drawings.

DETAILED DESCRIPTION OF THE INVENTION

Figure 1:
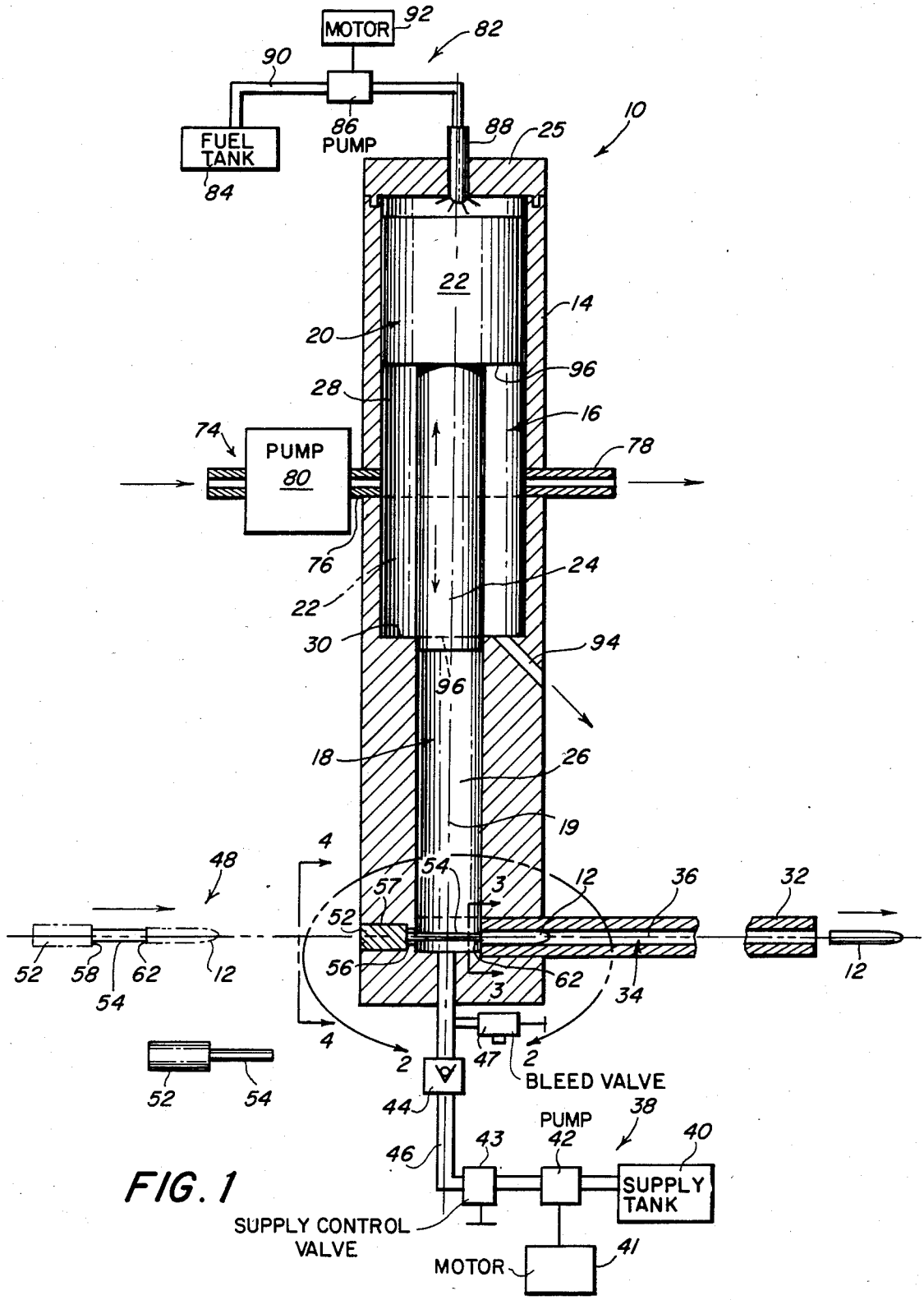
FIG. 1 is a combined diagrammatic and longitudinal sectional view of an embodiment of the improved gun system of the invention for launching one or more projectiles and illustrates in dotted and solid lines more than one operational condition of the invention.

With further reference to FIG. 1 of the drawings, a gaseous-propellant gun system 10 of the invention for launching one or more projectiles 12 is generally comprised of a housing 14 having enlarged and reduced chamber portions 16 and 18 between its ends. Both chamber portions 16 and 18 are coaxially and concentrically aligned in relation to axis 19 of the housing. A double-acting piston subassembly 20 of one-piece construction is provided with an enlarged tandem piston 22 and a reduced tandem piston 24. Subassembly 20 is slidably mounted for reciprocal movement in chamber portions 16 and 18 between the ends of the housing. Housing 14 is preferably constructed of a suitable grade of metal or an alloy thereof and is generally of elongated cylindrical-shaped configuration between its ends. Housing 14 may be made up of more than one interconnected section to facilitate fabrication, assembly, and servicing. However, for the sake of brevity, housing 14 is shown with only one removable capped end 25 for facilitating assembly and disassembly of piston subassembly 20 thereto. The piston subassembly is also preferably made up of a suitable grade of metal or an alloy thereof. The outside diameter of reduced piston 24 is substantially equal to the inside diameter of housing interior surface 26 that defines chamber portion 18. Similarly, the outside diameter of enlarged piston 22 is substantially equal to the inside diameter of housing interior surface 28 that defines enlarged chamber portion 16. A shoulder 30 of annular shape extends generally transverse of axis 19 and is interconnected to and interposed between surfaces 26 and 28. Reduced piston 24 has a length somewhat less than the length of the reduced chamber portion. However, the length of piston 24 is such that its free end is not slidably disconnected from the inner end of surface 26 when piston subassembly is fully advanced in one direction toward the one end of housing 14 during system use as shown by solid lines in FIG. 1. Moreover, piston 24 has a length such that when subassembly 20 is fully advanced in the opposite direction the free end of piston 24 is spaced from the opposite end of housing 14 as shown by dotted lines in FIG. 1. Enlarged piston 22 normally has a length of about one half that of the reduced piston. Piston 22 usually has a diameter of about twice that of piston 24.

A projectile launching barrel 32 having a bore 34 is connected to housing 14 at the opposite end thereof. Bore 34 is in direct open intercommunication with chamber 18. Bore axis 36 intersects housing axis 19 and is disposed generally at right angles thereto.

A lightweight gaseous source 38, such as helium, is also connected to the opposite end of the housing. Source 38 is generally made up of a supply tank 40, a pump 42 having a motor 41, a supply control valve 43 and a check valve 44. A conduit 46 is connected to the opposite end of housing 14 so as to be in direct open intercommunication with chamber 18. Conduit 46 series interconnects tank 40, pump 42, valve 43 and check valve 44. If desired valve 43 may be controlled by an electric motor (not shown). A bleed valve 47 is connected to conduit 46 and is interposed between housing 14 and check valve 44.

Figure 2:
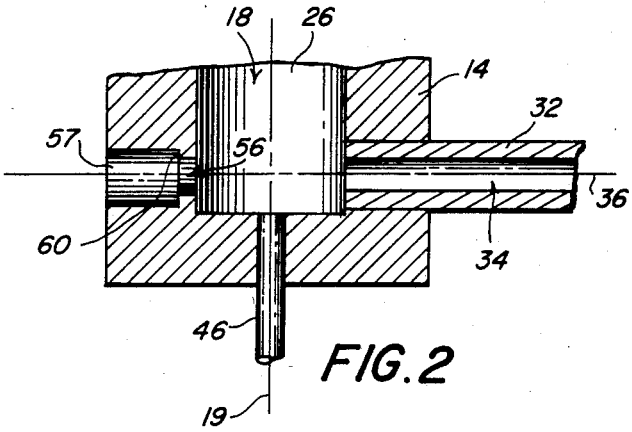
FIG. 2 is an enlarged sectional view with parts removed as taken within the bounds of encompassing line 2—2 of FIG. 1 and illustrates further details of the invention.
Figure 3:
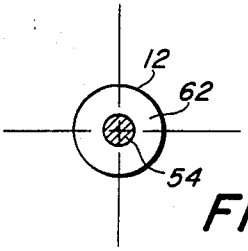
FIG. 3 is an enlarged cross-sectional view taken along line 3—3 of FIG. 1.

A projectile support and handling arrangement 48 is generally made up of a projectile 12, a mandrel 52 and an interconnecting stem 54 of reduced cross section. A transverse bore 56 and counter bore 57 are provided in the opposite end of housing 14 as shown in FIG. 2. Both bores 56 and 57 are coaxially aligned with bore axis 36 and disposed diametrically opposite therefrom. Bore 57 has a diameter substantially equal to the outside diameter of mandrel 52 such that mandrel 52 is slidably connected to the housing. Also, projectile 12 has a diameter substantially equal to the diameter of barrel bore 34 but less than the diameter of bore 56. Since the diameter of projectile 12 is less than mandrel 52 and since the diameter of stem portion 54 is less than projectile 12, each arrangement 48 with its projectile 12 being the forward end is freely inserted through bores 56 and 57 until mandrel shoulder 58 abuts housing shoulder 60 between bores 56 and 57 as depicted in FIGS. 1 and 2. By reason of mandrel shoulder 58 abutting shoulder 60, projectile 12 of a gun loaded arrangement 48 is in its proper inserted position for launching from the inner end of barrel bore 34 as depicted in FIG. 1.

At the time a projectile 12 is inserted in the inner end of bore 34, fluid pressure-responsive annular surface portion 62 of projectile 12 at its inner end adjacent the outer end of stem 54 is disposed in tangential alignment with annular surface 26 of housing 14 as shown in FIG. 1. As will become more apparent hereinafter, the junction between stem 54 and projectile 12 of an arrangement 48 is a line of weakness such that projectile 12 will fracture and separate from its associated stem so as to be propelled and launched from barrel 32 during system use. To facilitate fracture between projectile 12 and stem 54 of each arrangement 48 during use of system 10, an annular groove (not shown) can be provided at the junction between stem 54 and projectile 12.

Figure 4:
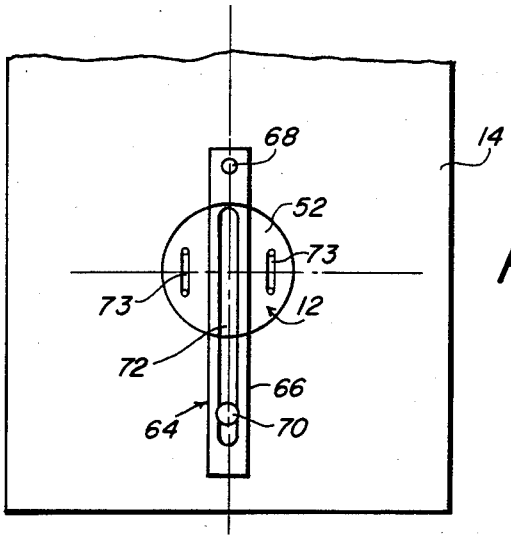
FIG. 4 is an enlarged elevational view taken along line 4–4 of FIG. 1 and illustrates further details for releasably securing the projectile support and handling subassembly of the invention.

Once an arrangement 48 is fully inserted in housing 14, it is releasably anchored or affixed thereto by an appropriate breech lock or the like. As depicted in FIG. 4, a suitable breech lock 64 is generally comprised of a bar element 66 and a pair of cap screws 68 and 70. One end of bar element 66 includes an elongated slot 72 such that after an arrangement 12 is fully inserted in housing 14, bar 66 is extended across the outer end of mandrel 52 until the opening (not shown) of bar 66 is aligned with a threaded opening (also not shown) of housing 14 for receiving cap screw 68. Upon tightening of cap screws 68 and 70 with bar 66 extending therebetween and with an arrangement 12 fully inserted in housing 14, the arrangement is then securely affixed thereto prior to an operative cycle of system 10. Depending on the rapidity for loading an arrangement 48 in housing 14 and then unloading of the remaining mandrel 52 and stem 54 of an expended arrangement (after launching its projectile 12) it is to be understood that any suitable releasable locking mechanism may be used other than that illustrated in FIG. 4. In removing the remaining mandrel 52 and stem 54 of arrangement 48 from housing 14, the outer end of mandrel 52 may be provided with a pair of relatively spaced hand pulls 73.

A forced air inlet and exhaust mechanism 74 is connected to housing 14 between its ends. Mechanism 74 is generally comprised of at least one inlet port 76 and at least one outlet port 78. Ports 76 and 78 are coaxially aligned and disposed generally transverse of housing axis 19. Ports 76 and 78 are interposed between the ends of chamber 16 such that each port 76 or 78 is in direct open communication with chamber 16 between pistons 22 and 24 when piston subassembly 20 is advanced toward the one end of housing 14 as depicted in FIG. 1. Similarly, ports 76 and 78 are in direct open intercommunication with chamber 16 between piston 22 and housing 14 when piston 22 is fully advanced toward the opposite end of chamber 16 as shown by dotted lines in FIG. 1. A suitable motor-driven gear-type pump 80 is connected to inlet 76 for supplying a continuous flow of air to chamber 16 during use of system 10 as will be more fully set forth hereinafter.

A fuel injection apparatus 82 is connected to the one end of housing 14. Apparatus 82 is generally made up of a fuel supply tank 84, fuel pump 86 and fuel injector 88. A conduit 90 series interconnects tank 84, pump 86 and fuel injector 88. An electric motor 92 drives pump 86 for timely causing injector 88 to inject by spraying a predetermined amount of atomized fuel into the compressed air of chamber 16 when piston subassembly 22 is advanced toward the one end of housing 14 as illustrated by solid lines in FIG. 1.

At least one vent 94 is provided in housing 14. Vent 94 is in direct open intercommunication with the opposite end of chamber 16. As depicted in FIG. 1, vent 94 extends between shoulder 30 and the exterior of housing 14. One of the reasons for vent 94 is to controllably release air from chamber 16 between piston portions 22 and 24 so as to minimize the impact of surface 96 of piston 22 against shoulder 30 when piston subassembly 20 is advanced towards the opposite end of housing 14 during system use.

In an operative embodiment of system 10, piston subassembly 20 is normally started for reciprocating movement from its position as shown by dotted lines in FIG. 1. Prior to subassembly starting from its dotted line position in FIG. 1, a projectile support and handling arrangement 48 usually has been fully inserted in housing 14 and releasably locked thereto by lock 64 as shown in FIG. 4. At the same time, pump 80 is admitting a volume of air in chamber 16 between housing 14 and piston 22. Then with pump 42 of pressurized source means 38 being actuated and valve 43 opened, conduit 46 admits a volume of pressurized relatively lightweight gaseous medium into chamber 18. The admitted medium progressively forces piston subassembly 20 in one direction toward fuel injector 88 at the one end of housing 14. After piston 22 advances in the one direction past ports 76 and 78, these ports admit another volume of air in chamber 16 between pistons 22 and 24. The admitted flow of air between pistons 22 and 24, despite exhaust of the flow through port 78 and vent 94, acts on piston surface 96 thereby biasingly urging piston subassembly toward the one end of the housing. Thus, the flow of air in chamber 16 that acts on surface 96 contributes to the action of the admitted pressurized medium in reduced chamber 18 in advancing the piston subassembly toward the housing one end. At a predetermined time when the advancement of piston subassembly 20 toward the housing one end substantially reduces the volume of chamber 16 between piston 22 and housing 14, pump 86 of device 82 timely admits a predetermined amount of fuel into (combustion) chamber 16 thereby mixing with the compressed and heated air to form an explosive fuel air admixture.

Figure 5:
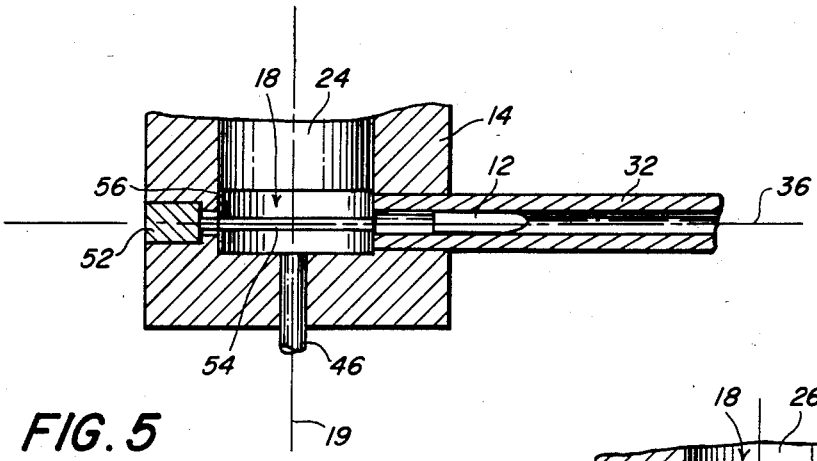
FIG. 5 is a sectional view similar to FIG. 2 with parts removed and other parts added and illustrates another operational condition of the invention.

Upon self-ignition and explosion of the fuel-air admixture, piston subassembly 20 is forcibly and rapidly driven in the other direction toward the opposite end of housing 14. As the piston subassembly is driven toward the opposite end, the admitted pressurized gaseous medium in chamber 18 is further pressurized by reason of check valve 44 closing off reverse flow in conduit 46. Continued advancement of the piston subassembly toward the opposite end of housing 14 causes piston 22 to close off ports 76 and 78 thereby creating a dampening but diminishing pressurised volume of air in chamber 16 between pistons 22 and 24 as result of vent 94 so as to gradually decelerate piston assembly 20 until its annular surface 96 abuts housing shoulder 30 as illustrated by dotted lined in FIG. 1. At this time, the pressurized gaseous medium in chamber 18 is fully compressed to its maximum pressure. The fully pressurized medium in chamber 18 then immediately acts on projectile surface 62 so as to cause fracture of projectile 12 from stem 54 and launching of same from barrel bore 34 to strike a target as illustrated in FIGS. 1 and 5.

Upon unlocking and removing the remaining mandrel 52 and stem 54 from housing 14, another unused subassembly is usually reloaded and locked in housing 14 for launching another projectile. Depending upon requirements for either intermittently or rapidly launching one or more projectiles 12 from housing 14, a suitable loading/unloading mechanism can be provided for arrangement 48.

In order to stop operation of system 10 after launching one or more projectiles 12 to destroy a target, bleed valve 47 is opened while supply valve 43 is turned off. As subassembly 20 reciprocates toward the opposite end, the remaining gaseous medium in chamber 18 is primarily exhausted through valve 47. Consequently, subassembly 20 at the end of its stroke in the opposite direction will stop in the dotted line position as shown in FIG. 1. If the arrangement 48 is inserted in housing 14 without a projectile 12 or is not inserted in barrel bore 36 or bores 36 and 56–57 such bore 36 or bores 36, 56, and 57 will assist bleed valve 47 in exhausting the remaining gaseous medium from chamber 18. After stopping subassembly 20, it is of course restarted for reciprocating movement in housing 14 by merely opening supply valve 43 and closing valve 47. Once steady-state conditions are reached in operating system 10, projectile support and handling arrangement 48 is inserted in housing 14 for timely launching a projectile 12 to strike a target.

Although not heretofore mentioned, it is to be understood that housing 14 may be supported by a trunnion arrangement (not shown) on a rotatable platform so that boresight axis 36 may be quickly and continually aimed such as by a target-tracking radar (not shown) in relation to the azimuth of a moving and tracked target. Also, the trunnion arrangement (not shown) includes means (not shown) that enables pivotal movement about the trunnion axis so that boresight axis 36 is continually elevated in either direction to maintain its aim on the moving and tracked target as the system 10 is being operated for launching one or more projectiles to strike the target. Depending on the operating requirements of system 10, suitable cooling means may be made a part of housing 14, especially at its fuel injection end so as to prevent overheating. Also, appropriate means (not shown) are associated with housing 14 for counterbalancing the reactionary forces when subassembly 20 is reciprocated.

Figure 6:
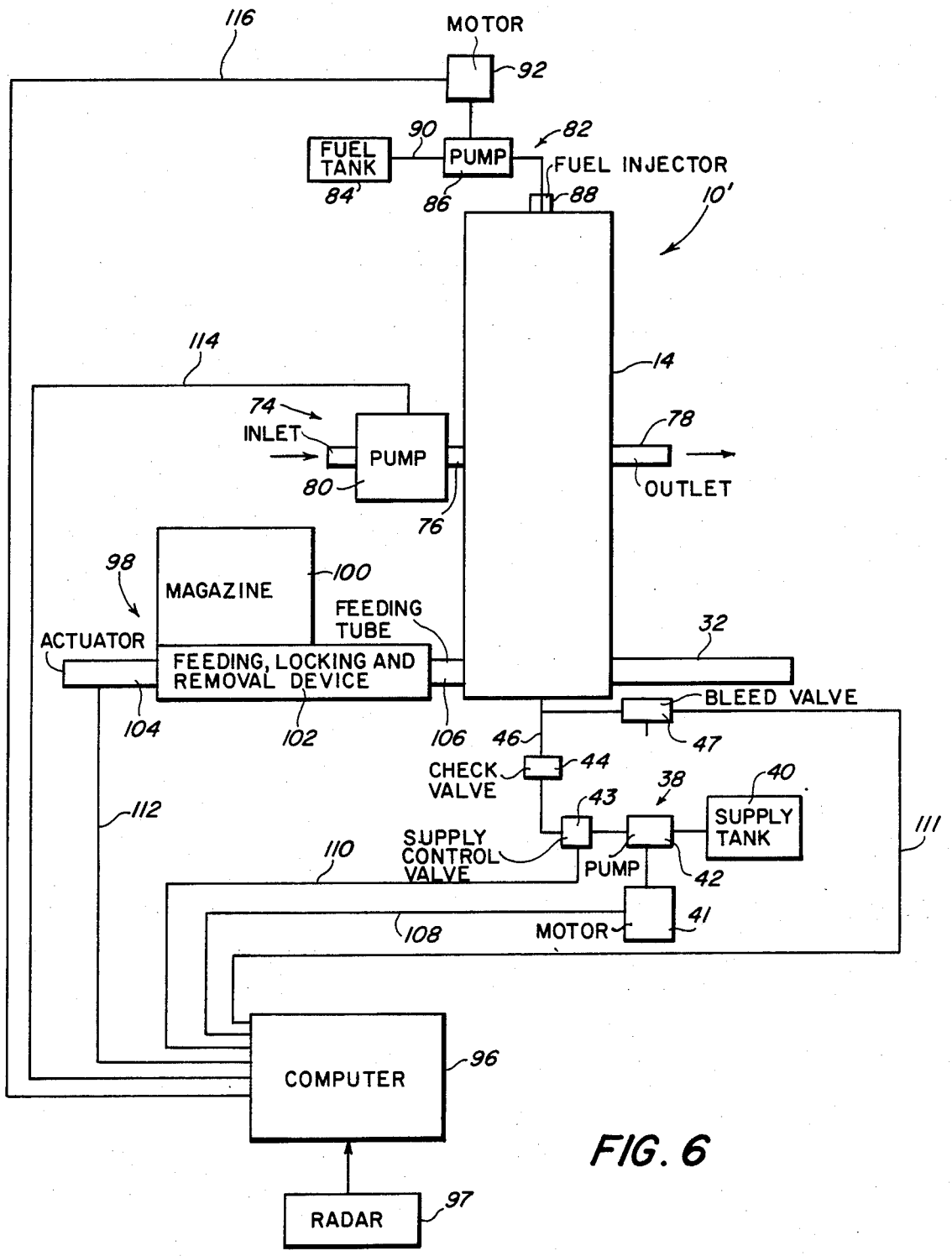
FIG. 6 is a schematic view of another embodiment of the invention.

In another embodiment of system 10' the various operations of gaseous pressure source means 38, loading/unloading of arrangement 48, forced air injection device 74 and fuel injection device 82 are automatically and selectively controlled by a master computer control 96 as shown in FIG. 6. The input to control 96 normally indicates a target of tracking radar 97. Instead of the manual loading and unloading of arrangement 48 as shown in FIG. 1, a magazine feeding, locking and removal apparatus 98 is provided for handling mandrel 52 and stem 54 with or without projectile 12. The apparatus is generally made up of a magazine 100; a feeding, locking and removal device 102; and an actuator 104 for device 102. Tubular element 106 interconnects device 102 to housing bore 57. Control 96 is connected by a series of leads 108, 110 and 111 to motor 41, valve 43, and valve 47 of device 38. Control 96 is also connected by lead 112 to actuator 104 of apparatus 98, by lead 114 to forced air pump 80, and by lead 116 to motor 92 of fuel injection pump 86. Since master control 96 can be programmed for effecting either intermittent or repetitive launch of one or more projectiles 12 from barrel 32 of system 10', it is evident that timely transmitted signals from the master control through leads 108, 110, 111, 112, 114 and 116 synchronize the various operations of devices 38, 98, 74 and 82 for controlling the reciprocation of piston subassembly 20 and the rate thereof between the opposed ends of housing 14 during each operative cycle of system 10 for effectively striking a tracked moving target.

In view of the foregoing it is evident that the invention is not limited to the embodiments described above but departures may be made therein within the scope of the accompanying claims without departing from the principles of the invention.

What is claimed is:

1. A gaseous propellant gun system for launching a projectile, said system comprising:

housing means having a chamber with enlarged and reduced chamber portions at opposite ends thereof, double-acting piston means having an enlarged piston means in the enlarged chamber portion at one end of the housing means and a reduced piston means in the reduced chamber portion at the opposite end of the housing means, barrel means connected to the housing means and having a bore therein in direct open communication with the reduced chamber portion;

relatively lightweight, gaseous source means connected to the housing means and being in direct open communication with the reduced chamber portion for admitting a compressible and pressurized gaseous medium to the reduced chamber portion during system use;

projectile support and handling means, said housing means including means for receiving the projectile support and handling means and for directing the projectile support and handling means such that the projectile thereof is inserted through the reduced chamber portion and in the bore at the inner end of the barrel means, the support means of the projectile support and handling means having a reduced intermediate portion connected to the projectile but fracturable from the projectile when the double-acting piston means is advanced toward the opposite end of the housing means with the projectile in the barrel bore and the compressible gaseous medium in the reduced chamber portion during system use, the projectile having a pressure responsive surface portion immediately adjacent to the reduced intermediate portion but facing in a direction toward the inside of the reduced chamber portion and arranged at an angle generally transverse to the barrel bore axis;

forced air inlet and exhaust means connected to the housing means for admitting a first volume of pressurized air in the enlarged chamber portion between the enlarged piston means and the one end of the housing means, the first volume of air being compressed by the enlarged piston means when the double-acting piston means advances toward the one end of the housing means, the forced air inlet and exhaust means for also introducing a second volume of pressurized air in the enlarged chamber portion between the enlarged and reduced piston means so as to biasingly urge the double-acting piston means in a direction towards the one end of the housing means and thereby assist in compressing the first volume of pressurized air, and fuel injection means connected to the housing means for timely injecting a preselected amount of fuel into the compressed first volume of air so as to cause admixing of the fuel and air and then ignition of the fuel-air admixture into an explosive admixture for driving the double-acting piston means in the other direction toward the opposite end of the housing means so as to progressively compress the relatively lightweight gaseous medium in the reduced chamber portion, the double-acting piston means at the end of its advancement in the other direction causing the compressed gaseous medium to act upon the pressure responsive surface portion of the projectile so as to generate a force for separating the projectile from the reduced intermediate portion of the projectile support and handling means thereby enabling launch of the projectile from the barrel means.

2. A system as set forth in claim 1 wherein said housing means includes a shoulder interposed between the reduced and enlarged chamber portions.

3. A system as set forth in claim 2 wherein said housing means includes vent means extending from the shoulder to vent the second volume of air between said reduced and enlarged piston means when the double-acting piston means is advanced toward the opposite end of the housing means.

4. A system as set forth in claim 3 wherein the vent means in venting the second volume of air between the enlarged and reduced piston means serves to minimize the impact of the enlarged piston means against the shoulder when the double-acting piston means is advanced toward the opposite end of said housing means.

5. A system as set forth in claim 2 wherein said fuel injection means injects a suitable grade of diesel fuel and the like.

6. A system as set forth in claim 1 wherein said fuel injection means includes fuel source and supply control means connected thereto.

7. A system as set forth in claim 1 wherein said forced air inlet and exhaust means is comprised of at least one inlet port and at least one outlet port.

8. A system as set forth in claim 1 wherein said forced air inlet and exhaust means is comprised of rotary gear-type pump means.

9. A system as set forth in claim 1 wherein said double-acting piston means is of one-piece construction; and wherein said enlarged and reduced piston means are arranged in tandem fashion.

10. A system as set forth in claim 1 wherein said housing means includes means for securing said projectile support and handling means thereto when said projectile support and handling means is inserted in the housing means during system use.

11. A system as set forth in claim 1 wherein said gaseous source means includes check valve means for restricting the direction of flow of the gaseous medium in a direction toward the opposite end of said housing means and into the reduced chamber portion.

12. A system as set forth in claim 1 wherein said gaseous source means includes gaseous-medium supply valve means, said valve means being operable for selectively controlling the admittance of the gaseous medium to the reduced chamber portion.

13. A system as set forth in claim 12 wherein said gaseous source means includes bleed valve means interposed between said housing means and the gaseous medium supply valve means.

14. A system as set forth in claim 1 wherein the gaseous medium is helium.

15. A system as set forth in claim 1 wherein the pressure responsive surface portion is of annular shape.

16. A system as set forth in claim 1 wherein the enlarged chamber portion is an internal combustion chamber.

17. A system as set forth in claim 1 wherein the double-acting piston means reciprocally advances first one direction then the other between the ends of the housing means during an operative cycle of the system.

18. A system as set forth in claim 1 wherein the projectile support and handling means including mandrel means for aligning the projectile in the barrel bore when the projectile is disposed in the barrel bore upon insertion of the projectile support and handling means into the housing means.

19. A system as set forth in claim 18 wherein the mandrel means is connected to the stem portion such that the stem portion is interposed between the mandrel means and the projectile of a projectile support and handling arrangement.

20. A system as set forth in claim 18 wherein the means for receiving the projectile support and handling means of the housing means includes bore means for receiving the mandrel means.

21. A system as set forth in claim 20 wherein the bore means is provided with counterbore means, wherein the housing means includes shoulder means between the bore means and counterbore means, and wherein the shoulder means engages the mandrel means so as to precisely position to the projectile in the barrel bore when a projectile support and handling means is inserted in the housing means during system use.

22. A system as set forth in claim 18 wherein the mandrel means is provided with means for facilitating removal of a projectile support and handling means from the housing means during system use.

23. A system as set forth in claim 18 wherein the mandrel means, stem portion, and projectile of a projectile support and handling means are longitudinally aligned.

24. A system as set forth in claim 20 wherein the axis of the bore means of the housing means is disposed diametrically opposite from and substantially coincides with the axis of the barrel bore.

25. A system as set forth in claim 20 wherein the bore means of the housing means and the barrel bore are spaced from the reduced piston means when the double-acting piston means is fully advanced toward the opposite end of the housing means during system use.

* * * * *